US007196308B2

(12) United States Patent
Okutani

(10) Patent No.: US 7,196,308 B2
(45) Date of Patent: Mar. 27, 2007

(54) DATA LINE DRIVER CAPABLE OF GENERATING FIXED GRADATION VOLTAGE WITHOUT SWITCHES

(75) Inventor: Shigeki Okutani, Shiga (JP)

(73) Assignee: NEC Electronics Corporation, Kanagawa (JP)

( * ) Notice: Subject to any disclaimer, the term of this patent is extended or adjusted under 35 U.S.C. 154(b) by 54 days.

(21) Appl. No.: 11/165,263

(22) Filed: Jun. 24, 2005

(65) Prior Publication Data

US 2005/0286307 A1 Dec. 29, 2005

(30) Foreign Application Priority Data

Jun. 29, 2004 (JP) ..... 2004-190794

(51) Int. Cl.
*G09G 3/36* (2006.01)

(52) U.S. Cl. ..... 250/208.2; 250/214 R; 345/87; 345/98

(58) Field of Classification Search ..... 250/208.1, 250/208.2, 208.3, 214 R, 214 SW; 345/87, 345/98, 99, 100
See application file for complete search history.

(56) References Cited

U.S. PATENT DOCUMENTS 6,977,634 B2 * 12/2005 Kim et al. ..... 345/87
2004/0032385 A1 * 2/2004 Park et al. ..... 345/95

FOREIGN PATENT DOCUMENTS

EP 1 061 499 A2 12/2000
JP 2001-060078 3/2001

* cited by examiner

*Primary Examiner*—Kevin Pyo
(74) *Attorney, Agent, or Firm*—Foley & Lardner LLP

(57) ABSTRACT

In a data line driver for driving data lines of a display apparatus including a data register adapted to sequentially latch video data signals in synchronization with latch signals, a data latch circuit adapted to latch all the sequential video data signals latched in the data register in synchronization with a strobe signal to generate digital output signals, a digital/analog converter adapted to convert the digital output signals of the data latch circuit into analog signals, and an output buffer adapted to apply the analog signals of the digital/analog converter to the data lines, the data latch circuit has a reset terminal adapted to receive a reset signal, so that the digital output signals of the data latch circuit are reset by the reset signal to fixed gradation data regardless of the strobe signal.

10 Claims, 16 Drawing Sheets

| D | G | Q |
|---|---|---|
| 0 | 1 | 0 |
| 1 | 1 | 1 |
| 0 | 0 | HOLD |
| 1 | 0 | HOLD |

| R | D | G | Q |
|---|---|---|---|
| 1 | 0 | 1 | 0 |
| 1 | 1 | 1 | 1 |
| 1 | 0 | 0 | HOLD |
| 1 | 1 | 0 | HOLD |
| 0 | 0 | 1 | 0 |
| 0 | 1 | 1 | 0 |
| 0 | 0 | 0 | 0 |
| 0 | 1 | 0 | 0 |

| R | D | G | Q |
|---|---|---|---|
| 1 | 0 | 1 | 0 |
| 1 | 1 | 1 | 1 |
| 1 | 0 | 0 | HOLD |
| 1 | 1 | 0 | HOLD |
| 0 | 0 | 1 | 1 |
| 0 | 1 | 1 | 1 |
| 0 | 0 | 0 | 1 |
| 0 | 1 | 0 | 1 |

DATA LINE DRIVER CAPABLE OF GENERATING FIXED GRADATION VOLTAGE WITHOUT SWITCHES

BACKGROUND OF THE INVENTION

1. Field of the Invention

The present invention relates to a data line driver of a plane type display apparatus such as a liquid crystal display (LCD) apparatus.

2. Description of the Related Art

In a plane type display apparatus including a panel having data lines (or signal lines), scan lines (or gate lines) and cells each located at one intersection between the data lines and the scan lines, a data line driver for driving the data lines, and a scan line driver for driving the scan lines.

In order to improve the quality of a moving image, i.e., in order to improve the removing effect of a residual image of a moving image, the data line driver switches a gradation voltage with a black voltage (see: JP-2001-60078-A). For example, the data line driver includes a switch circuit for applying the black voltage instead of the output signals of an output buffer to data lines (see: FIG. 2 of JP-2001-60078-A) or a switch circuit for generating black data instead of the output signal of a data register (see: FIG. 3 of JP-2001-60078-A). This will be explained later in detail.

In the above-described prior art data line driver, however, since the switch circuit requires an enormous number of switches, the size of the data line driver is increased. Also, if another fixed intermediate gradation voltage, not the black voltage, is required to be applied to the data lines, the connections therefor are so complicated that the size of the data line driver is further increased.

SUMMARY OF THE INVENTION

It is an object of the present invention to provide a small-sized data line driver for a plane type display apparatus capable of improving the quality of a moving image.

Another object is to provide a data line driver for a plane type display apparatus capable of applying a fixed intermediate gradation voltage to data lines.

According to the present invention, in a data line driver for driving data lines of a display apparatus including a data register adapted to sequentially latch video data signals in synchronization with latch signals, a data latch circuit adapted to latch all the sequential video data signals latched in the data register in synchronization with a strobe signal to generate digital output signals, a digital/analog converter adapted to convert the digital output signals of the data latch circuit into analog signals, and an output buffer adapted to apply the analog signals of the digital/analog converter to the data lines, the data latch circuit has a reset terminal adapted to receive a reset signal, so that the digital output signals of the data latch circuit are reset by the reset signal to fixed gradation data regardless of the strobe signal.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENTS

Before the description of the preferred embodiments, a prior art LCD apparatus will be explained with reference to FIGS. 1, 2, 3A, 3B, 4A, 4B and 5.

Figure 1:
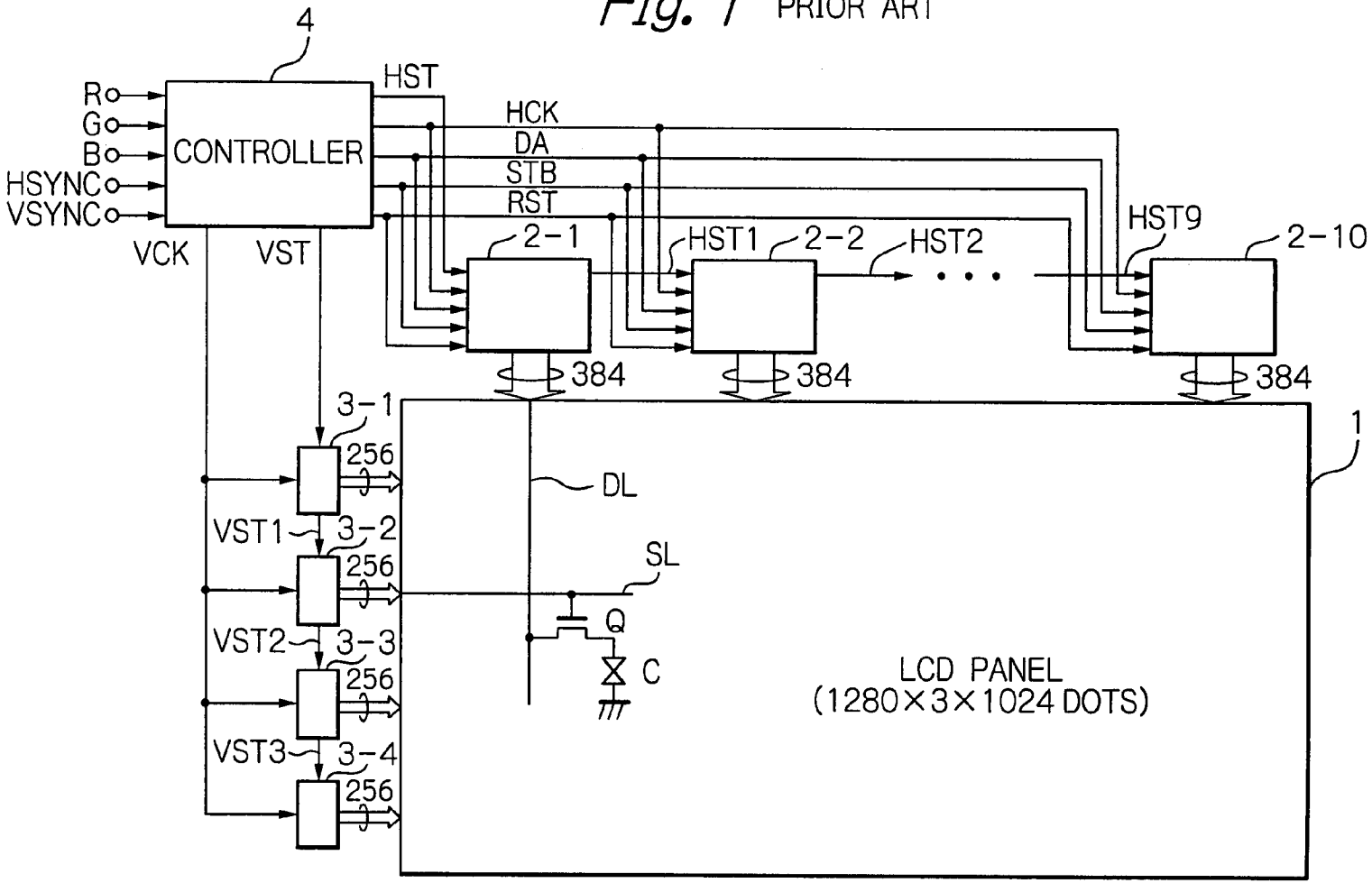
Fig. 1 PRIOR ART
FIG. 1 is a block circuit diagram illustrating a prior art LCD apparatus.

In FIG. 1, which illustrates a prior art LCD apparatus, reference numeral 1 designates an LCD panel having 1280×1024 pixels each formed by three color dots, i.e., R (red), G (green) and B (blue). Therefore, the LCD panel 1 includes 3932160 dots located at 3840 (=1028×3) data lines (or signal lines) DL and 1024 scan lines (or gate lines) SL. One dot is formed by one thin film transistor Q and one liquid crystal cell C. For example, if one dot is represented by 64 gradation voltages, one pixel is represented by 262144 (=64×64×64) colors. This LCD panel is called a super extended graphics array (SXGA).

In order to drive the 3840 data lines DL, ten data line drivers 2-1, 2—2, . . . , 2-10 each for driving 384 data lines are provided along a horizontal edge of the LCD panel 1. On the other hand, in order to drive the 1024 scan lines SL, four scan line drivers 3-1, 3-2, 3—3 and 3-4 each for driving 256 scan lines are provided along a vertical edge of the LCD panel 1.

A controller 4 receives color signals R, G and B, a horizontal synchronization signal HSYNC and a vertical synchronization signal VSYNC from a personal computer or the line using a low voltage differential signaling (LVDS) interface, and generates a horizontal start signal HST, a horizontal clock signal HCK, a video signal DA, a strobe signal STB for the data line drivers 2-1, 2—2, . . . , 2-10, a reset signal RST for supplying a black voltage BV to the data lines DL, a vertical start signal VST and a vertical clock signal VCK for the gate line drivers 3-1, 3-2, 3—3 and 3-4.

In FIG. 1, the data line drivers 2-1, 2—2, . . . , 2-10 are arranged by a cascade connection method to pass the horizontal start signal HST therethrough in synchronization with the horizontal clock signal HCK. In this case, if a horizontal start signal output from the data line driver 2-1 is denoted by HST1, the horizontal start signal HST1 is supplied to the data line driver 2—2. Also, if a horizontal start signal output from the data line driver 2—2 is denoted by HST2, the horizontal start signal HST2 is supplied to the data line driver 2-3. Further, if a horizontal start signal output from the data line driver 2-9 is denoted by HST9, the horizontal start signal HST9 is supplied to the data line driver 2-10.

Also, in FIG. 1, the scan line drivers 3-1, 3-2, 3—3 and 3-4 are arranged by a cascade connection method to pass the vertical start signal VST therethrough in synchronization with the vertical clock signal VCK. In this case, if a vertical start signal output from the scan line driver 3-1 is denoted by VST1, the vertical start signal VST1 is supplied to the scan line driver 3-2. Also, if a vertical start signal output from the data line driver 3-2 is denoted by VST2, the vertical start signal VST2 is supplied to the scan line driver 3—3. Further, if a vertical start signal output from the scan line driver 3—3 is denoted by VST3, the vertical start signal VST3 is supplied to the scan line driver 3-4.

The operation of the LCD apparatus of FIG. 1 will now be briefly explained. A vertical start signal VST is shifted within the shift registers of each of the scan line drivers 3-1, 3-2, 3—3 and 3-4, so that one scan line is selected to turn ON all the thin film transistors Q connected thereto. On the other hand, a horizontal start signal HST is shifted within the shift registers of each of the data line drivers 2-1, 2—2, . . . , 2-10, so that video data of one scan line is latched. Then, the gradation voltages corresponding to the video data are applied by the strobe signal STB via the thin film transistors at the scan line to the liquid crystal cells C thereof. After that, the gradation voltages applied to the liquid crystal cells C are maintained until the next selecting operation is performed thereon.

Figure 2:
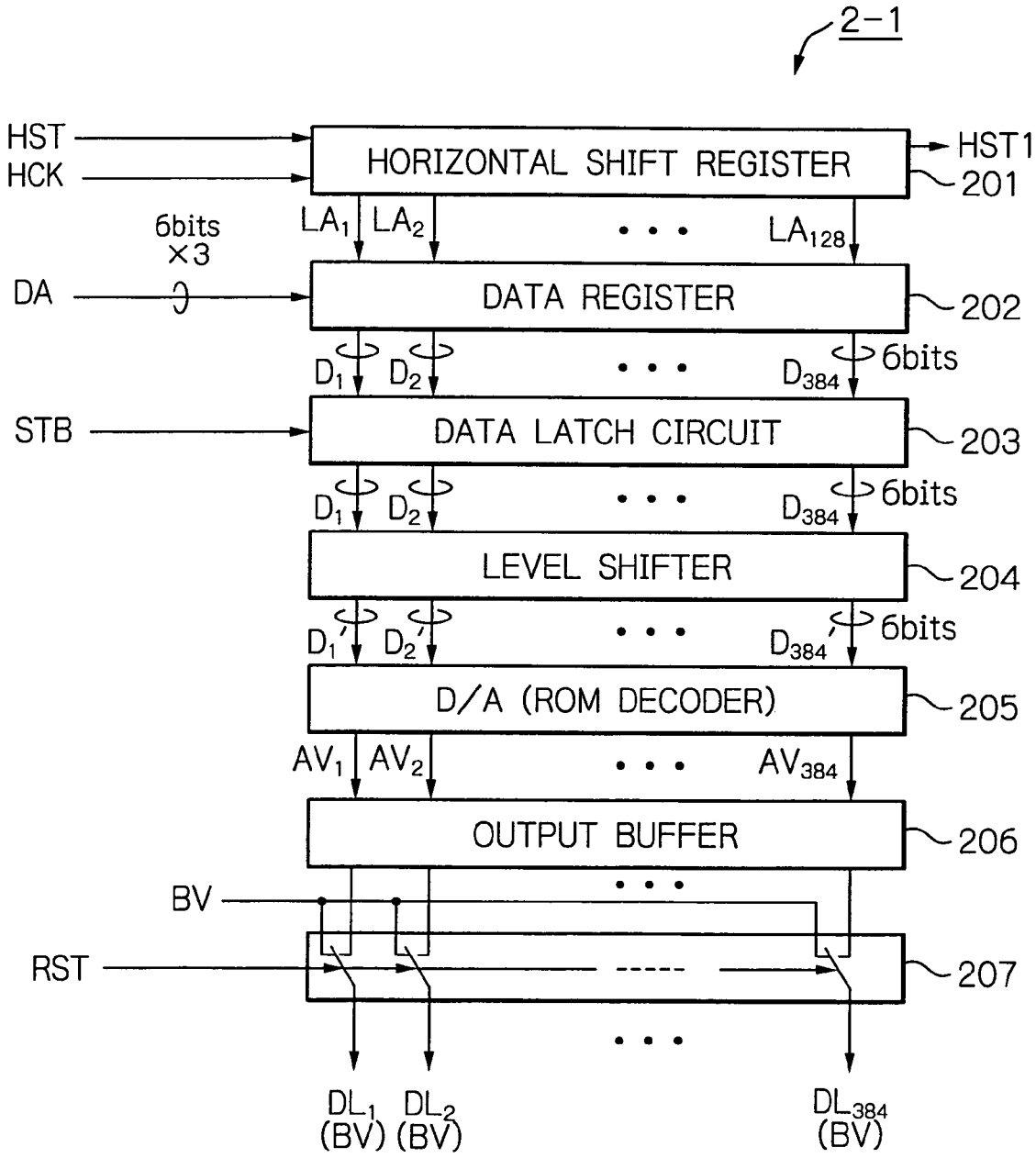
Fig. 2 PRIOR ART
FIG. 2 is a detailed block circuit diagram of the data line driver of FIG. 1.

In FIG. 2, which is a detailed block circuit diagram of the data line driver 2-1 of FIG. 1, the data line driver 2-1 is constructed by a horizontal shift register 201, a data register 202, a data latch circuit 203, a level shifter 204, a digital/analog (D/A) converter 205, and an output buffer 206 formed by voltage followers, and a switch circuit 207 for applying the output signal of the output buffer 207 or the black voltage BV to data lines $DL_1$, $DL_2$, . . . , $DL_{384}$ (see: FIG. 2 of JP-2001-60078-A).

The horizontal shift register 201 shifts the horizontal start signal HST in synchronization with the horizontal clock signal HCK, to sequentially generate latch signals $LA_1$, $LA_2$, . . . , $LA_{128}$. The horizontal shift register 201 also generates the horizontal start signal HST1 for the next stage data line driver 2—2.

The data register 202 latches the video signals DA (18 bits) formed by red data (R) (6 bits), green data (G) (6 bits) and blue data (B) (6 bits) in synchronization with the latch signals $LA_1$, $LA_2$, . . . , $LA_{128}$, to generate video signals $D_1$, $D_2$, . . . , $D_{384}$, respectively. The video signals $D_1$, $D_2$, . . . , $D_{384}$ are supplied to the data latch circuit 203.

The data latch circuit 203 latches the video signals $D_1$, $D_2$, . . . , $D_{384}$ of the data register 202 in synchronization with the strobe signal STB. This will be explained later in detail.

The level shifter 204 shifts the video signals $D_1$, $D_2$, . . . , $D_{384}$ by a level shift amount ΔV applied to the liquid crystal of the LCD panel 1 to generate video signals $D_1'$, $D_2'$, . . . , $D_{384}'$. That is, the level shift amount ΔV is a preset voltage to initiate the change of the transmittance of the liquid crystal.

The D/A converter 205 performs D/A conversions upon the shifted video signals $D_1'$, $D_2'$, . . . , $D_{384}'$, using the multi-gradation voltages such as 64 gradation voltages to generate analog voltages $AV_1$, $AV_2$, . . . , $AV_{384}$ which are applied via the output buffer 206 to the switch circuit 207.

When the reset signal RST is high (="1"), the switch circuit 207 applies the analog voltages $AV_1$, $AV_2$, . . . , $AV_{384}$ to the data lines $DL_1$, $DL_2$, . . . , $DL_{384}$, respectively. On the other hand, when the reset signal RST is low (="0"), the switch circuit 207 applies the black voltage BV to the data lines $DL_1$, $DL_2$, . . . , $DL_{384}$.

Figures 3A, 3B:
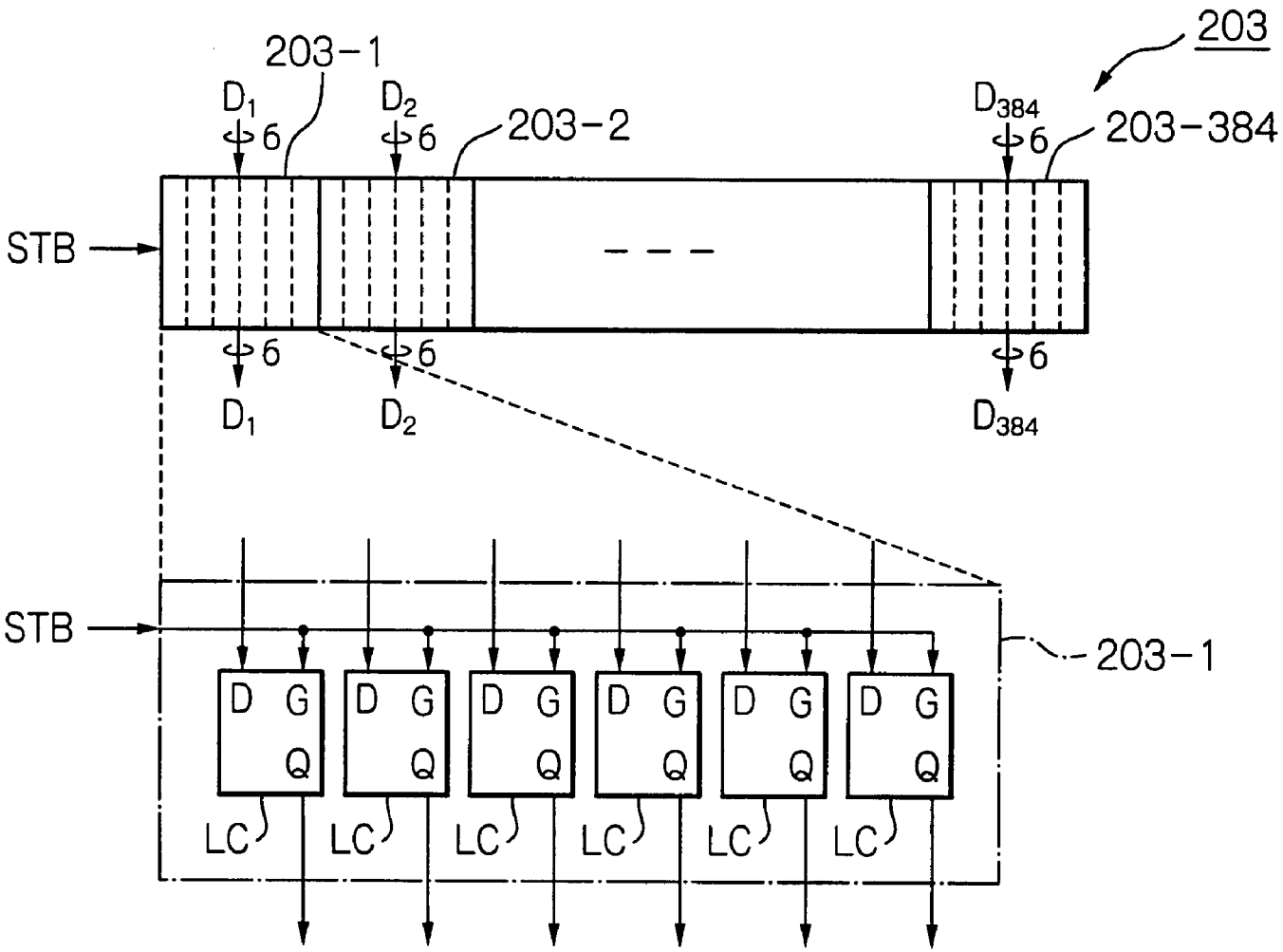
Fig. 3A PRIOR ART
Fig. 3B PRIOR ART
FIG. 3A is a detailed block circuit diagram of the data latch circuit of FIG. 2.
FIG. 3B is a detailed block circuit diagram of the 6-bit latch circuit of FIG. 3A.

The data latch circuit 203 is constructed by 384 6-bit latch circuits 203-1, 203-2, . . . , 203–384 as illustrated in FIG. 3A, and each of the 6-bit latch circuits 203-1, 203-2, . . . , 203–384 is constructed by six D-type latch circuits LC as illustrated in FIG. 3B. That is, the 6-bit latch circuits 203-1, 203-2, . . . , 203–384 latch the video data signal $D_1$, $D_2$, . . . , $D_{384}$, respectively, of the data register 202 in synchronization with a rising edge of the strobe signal STB.

Figures 4A, 4B:
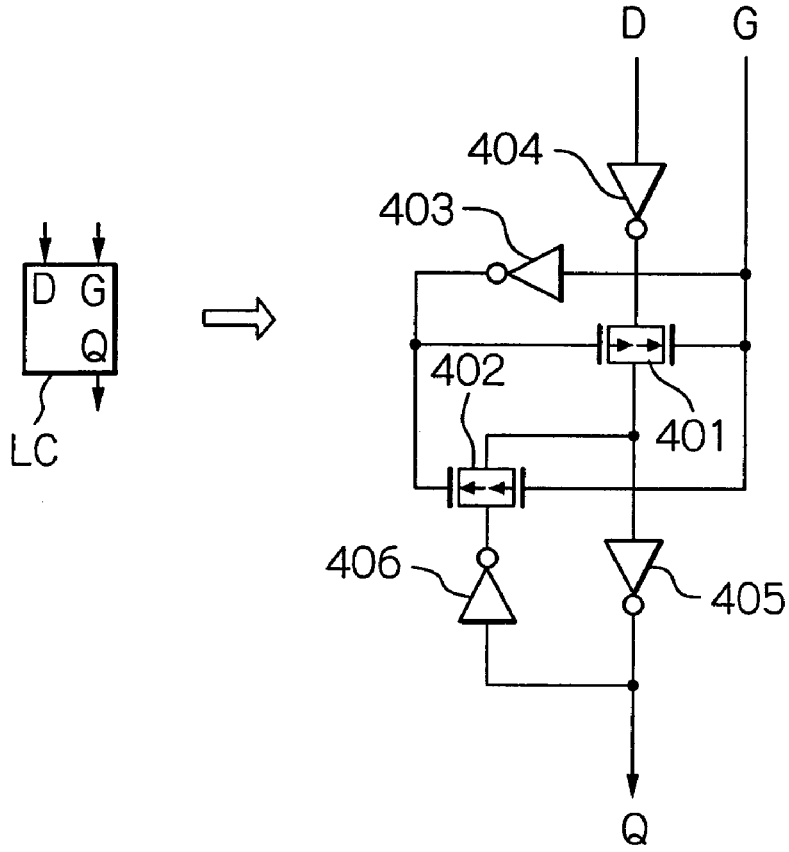
Fig. 4A PRIOR ART
Fig. 4B PRIOR ART
FIG. 4A is a logic circuit diagram of the D-type latch circuit of FIG. 3B.
FIG. 4B is a truth table of the D-type latch circuit of FIG. 4A.

As illustrated in FIG. 4A, the D-type latch circuit LC is constructed by transfer gates 401 and 402 and inverters 403, 404, 405 and 406, and operates in accordance with the truth table of FIG. 4B.

That is, when the voltage at a gate terminal G is high (="1"), the transfer gates 401 and 402 are turned ON and OFF, respectively. As a result, the voltage at a data terminal D passes through the inverter 404, the transfer gate 401 and the inverter 405 to reach an output terminal Q. On the other hand, when the voltage at the gate terminal G is low (="0"), the transfer gates 401 and 402 are turned OFF and ON, respectively. As a result, the voltage at the data terminal Q is positively fed back from the output terminal Q via the inverter 406 and the transfer gate 402 and the inverter 405 to the output terminal Q, so that the voltage at the output terminal Q is held.

Figure 5:
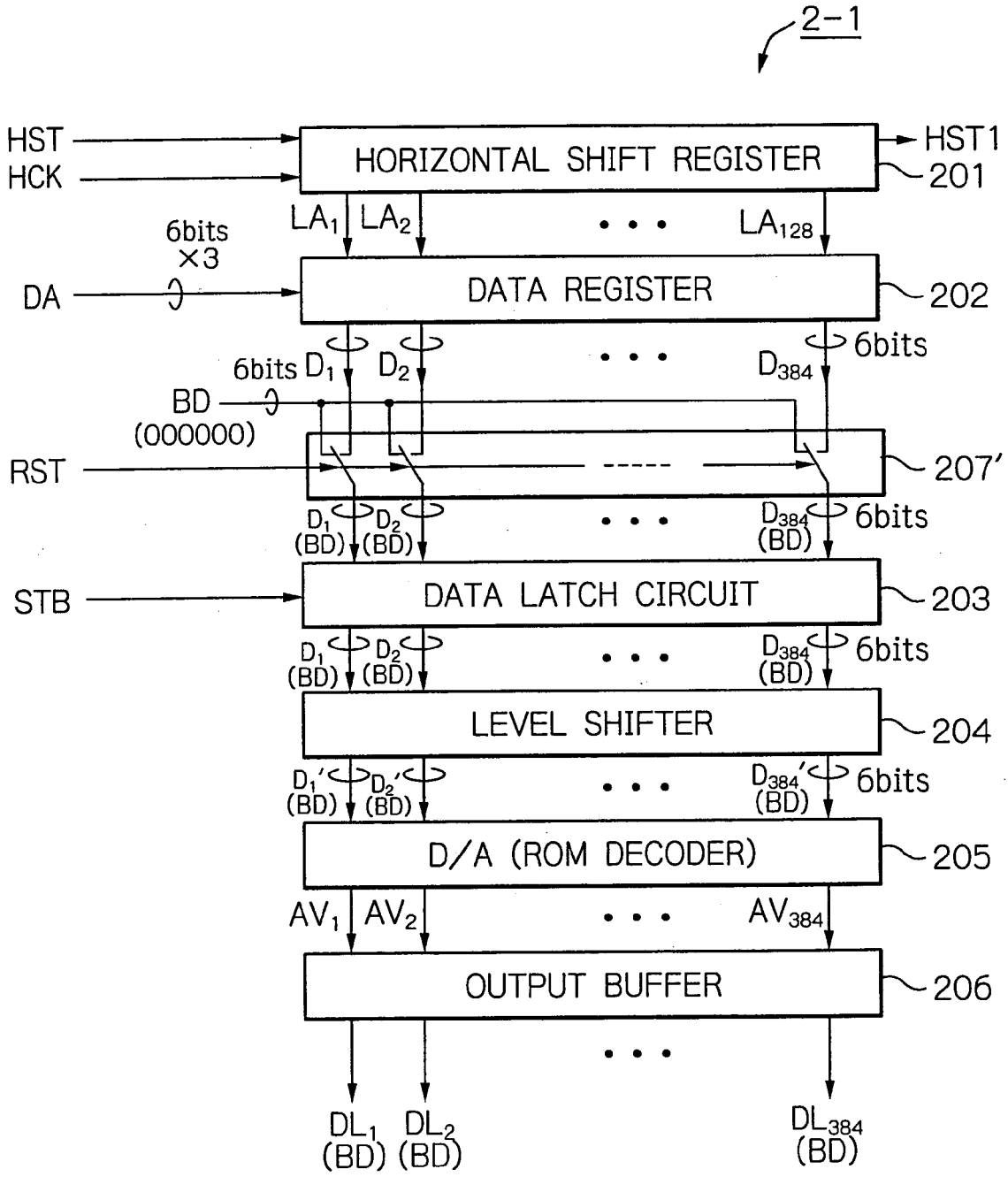
Fig. 5 PRIOR ART
FIG. 5 is a block circuit diagram of a modification of the data line driver of FIG. 2.

In FIG. 5, which illustrates a modification of the data line driver of FIG. 2, instead of the switch circuit 207 of FIG. 2, a switch circuit 207' similar to the switch circuit 207 of FIG. 2 is provided between the data register 202 and the data latch circuit 203 of FIG. 2 (see: FIG. 3 of JP-2001-60078-A).

The switch circuit 207' applies the output signal of the data register 202 or black data BD (=000000) corresponding to the black voltage BV of FIG. 2 to the level shifter 204. That is, when the reset signal RST is high (="1"), the switch circuit 207' applies the output signal of the data register 202 to the data latch circuit 203. On the other hand, when the reset signal RST is low (="0"), the switch circuit 207 applies the black data BD to the data latch circuit 203.

In FIGS. 2 and 5, however, since the switch circuit 207 or 207' requires an enormous number of switches such as 384 switches or 2304 (=384×6) switches, the size of the data line drivers 2-1, 2–2, . . . , 2-10 is increased. Also, if another fixed intermediate gradation voltage, not the black voltage BV, is required to be applied to the data lines $DL_1$, $DL_2$, . . . , $DL_{384}$, the connections therefor are so complicated that the size of the data line drivers 2-1, 2–2, . . . , 2-10 is further increased.

Figure 6:
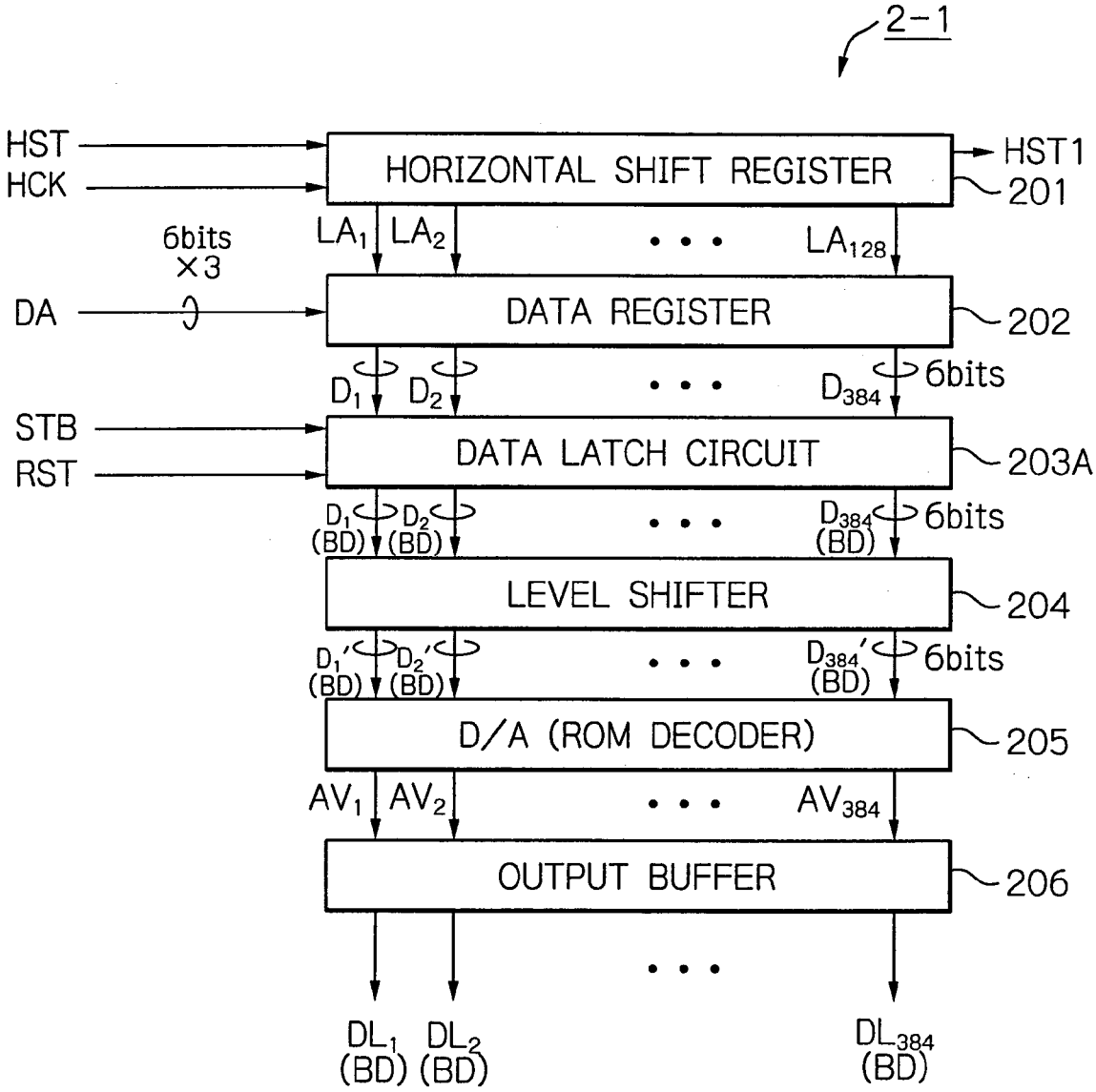
FIG. 6 is a block circuit diagram illustrating a first embodiment of the data line driver according to the present invention.

In FIG. 6, which illustrates a first embodiment of the data line driver according to the present invention, the data latch circuit 203 of FIG. 2 or 5 is replaced by a data latch circuit 203A, instead of providing the switch circuit 207 or 207' of FIG. 2 or 5. In FIG. 6, note that black data is defined by fixed gradation data (000000).

Figures 7A, 7B:
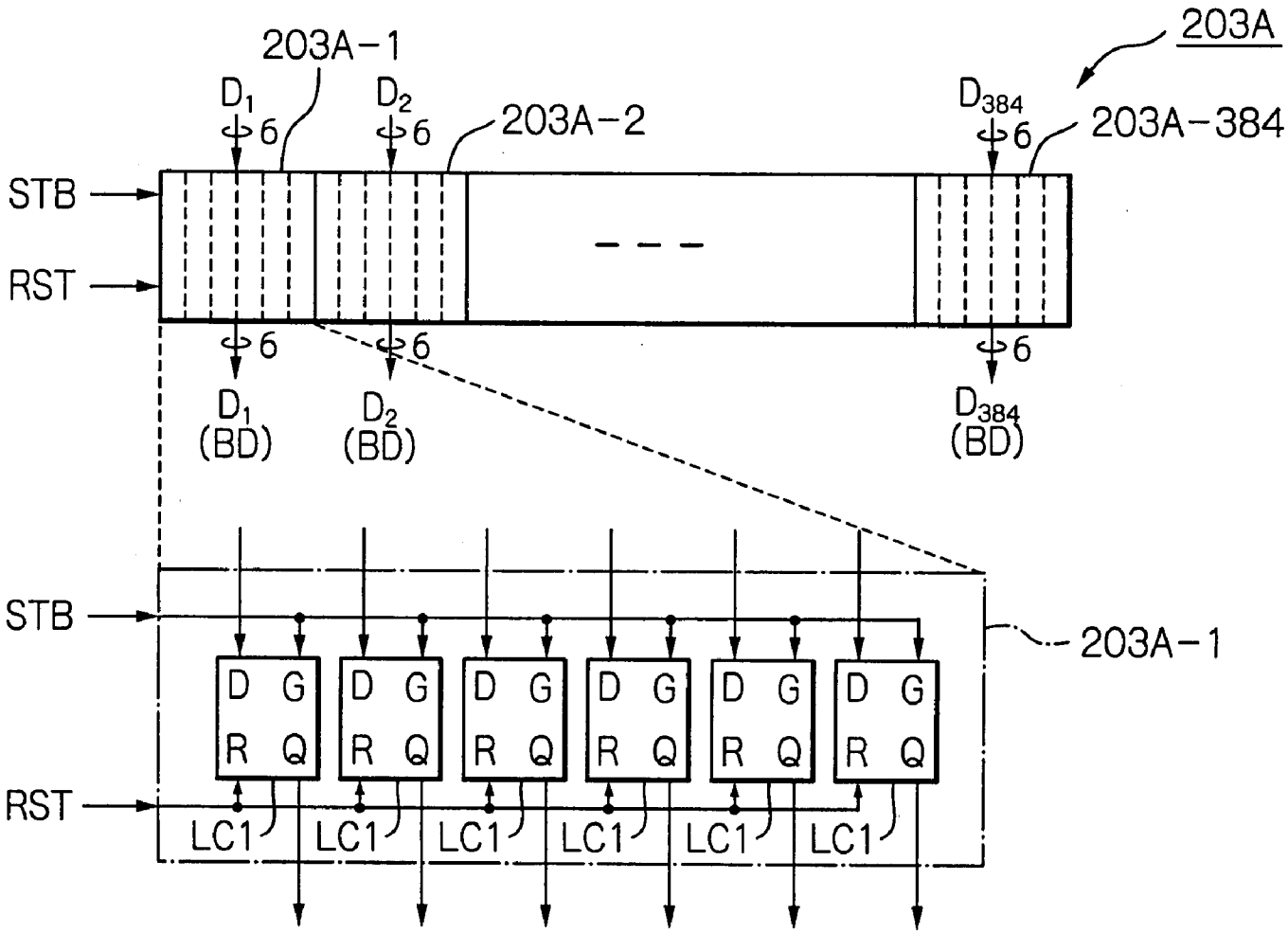
FIG. 7A is a detailed block circuit diagram of the data latch circuit of FIG. 6.
FIG. 7B is a detailed block circuit diagram of the 6-bit latch circuit of FIG. 7A.

The data latch circuit 203A is constructed by 384 6-bit latch circuits 203A-1, 203A-2, . . . , 203A–384 as illustrated in FIG. 7A, and each of the 6-bit latch circuits 203A-1, 203A-2, . . . , 203A–384 is constructed by six reset-type D-type latch circuits LC1 as illustrated in FIG. 7B. That is, the 6-bit latch circuits 203A-1, 203A-2, . . . , 203A–384 latch the video data signals $D_1$, $D_2$, . . . , $D_{384}$, respectively, of the data register 202 in synchronization with a rising edge of the strobe signal STB. On the other hand, the 6-bit latch circuits 203A-1, 203A-2, . . . , 203A–384 are reset by the reset signal RST so that each of the 6-bit latch circuits 203A-1, 203A-2, . . . , 203A–384 generates black data (=000000).

Figures 8A, 8B:
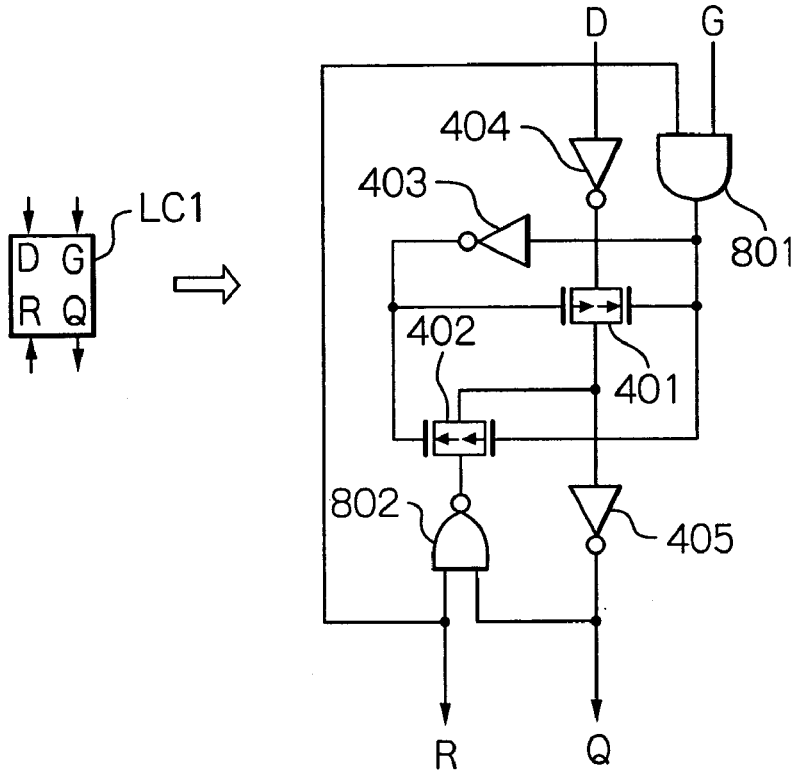
FIG. 8A is a logic circuit diagram of the reset-type D-type latch circuit of FIG. 7B.
FIG. 8B is a truth table of the reset-type D-type latch circuit of FIG. 7A.

As illustrated in FIG. 8A, in the reset-type D-type latch circuit LC1, an AND circuit 801 for receiving the reset signal RST is added to the elements of the D-type latch circuit LC of FIG. 4A and the inverter 406 of the D-type latch circuit LC of FIG. 4A is replaced by a NAND circuit for receiving the reset signal RST. Therefore, the reset-type D-type latch circuit LC1 operates in accordance with the truth table of FIG. 8B.

When the reset signal RST is high (="1"), the reset-type D-type latch circuit LC1 operates in the same way as the D-type latch circuit LC of FIG. 4A. That is, when the voltage at the gate terminal G is high (="1"), the transfer gates 401 and 402 are turned ON and OFF, respectively. As a result, the voltage at the data terminal D passes through the inverter 404, the transfer gate 401 and the inverter 405 to reach the output terminal Q. On the other hand, when the voltage at the gate terminal G is low (="0"), the transfer gates 401 and 402 are turned OFF and ON, respectively. As a result, the voltage at the data terminal Q is positively fed back from the output terminal Q via the NAND circuit 802 and the transfer gate 402 and the inverter 405 to the output terminal Q, so that the voltage at the output terminal Q is held.

When the reset signal RST is low (="0"), the reset-type D-type latch circuit LC1 is reset. That is, the output signal of the AND circuit 801 is low (="0") regardless of the voltage at the gate terminal G, so that the transfer gates 401 and 402 are turned OFF and ON, respectively. Also, the output signal of the NAND circuit 802 is high (="1") regardless of the voltage at the output terminal Q. As a result, the output signal of the NAND circuit 802 (="1") passes through the transfer gate 402 and the inverter 405, so that the voltage at the output terminal Q is reset at low (="0").

Thus, when the reset signal RST is low (="0"), the data latch circuit 203A is reset, so that the black data BD is applied to the data lines $DL_1$, $DL_2$, . . . , $DL_{384}$.

A first operation of the data line driver of FIG. 6 is explained next with reference to FIG. 9 which shows an operation for one data line such as $DL_1$.

First, at time t1, a horizontal start signal HST is generated, so that the horizontal shift register 201 generates a latch signal $LA_1$ in synchronization with a horizontal clock signal HCK. As a result, a video signal $D_1$ is latched as an effective data (1) in the data register 202 and is supplied to the data latch circuit 203A for the data line $DL_1$.

Next, at time t2, when a reset signal RST is changed from high to low, reset-type D-type latch circuits LC1 of the data latch circuit 203A are reset, so that the data latch circuit 203A generates black data (=000000). As a result, the black data is supplied via the level shifter 204 and the D/A converter 205 to the output buffer 206. Thus, a black voltage corresponding to the black data is applied to the data line $DL_1$.

Next, at time t3, the reset signal RST is changed from low to high, so that the black data remains in the data latch circuit 203A for the data line $DL_1$. Thus, the black voltage at the data line $DL_1$ is retained.

Finally, at time t4, when a strobe signal STB is generated while the reset signal RST remains high, the reset-type D-type latch circuit LC1 of the data latch circuit 203A passes the effective data (1) of the video signal $D_1$ via the level shifter 204 and the D/A converter 205 to the output buffer 206. As a result, a gradation voltage corresponding to the effective data (1) of the video signal $D_1$ is applied to the data line $DL_1$.

Figure 9:
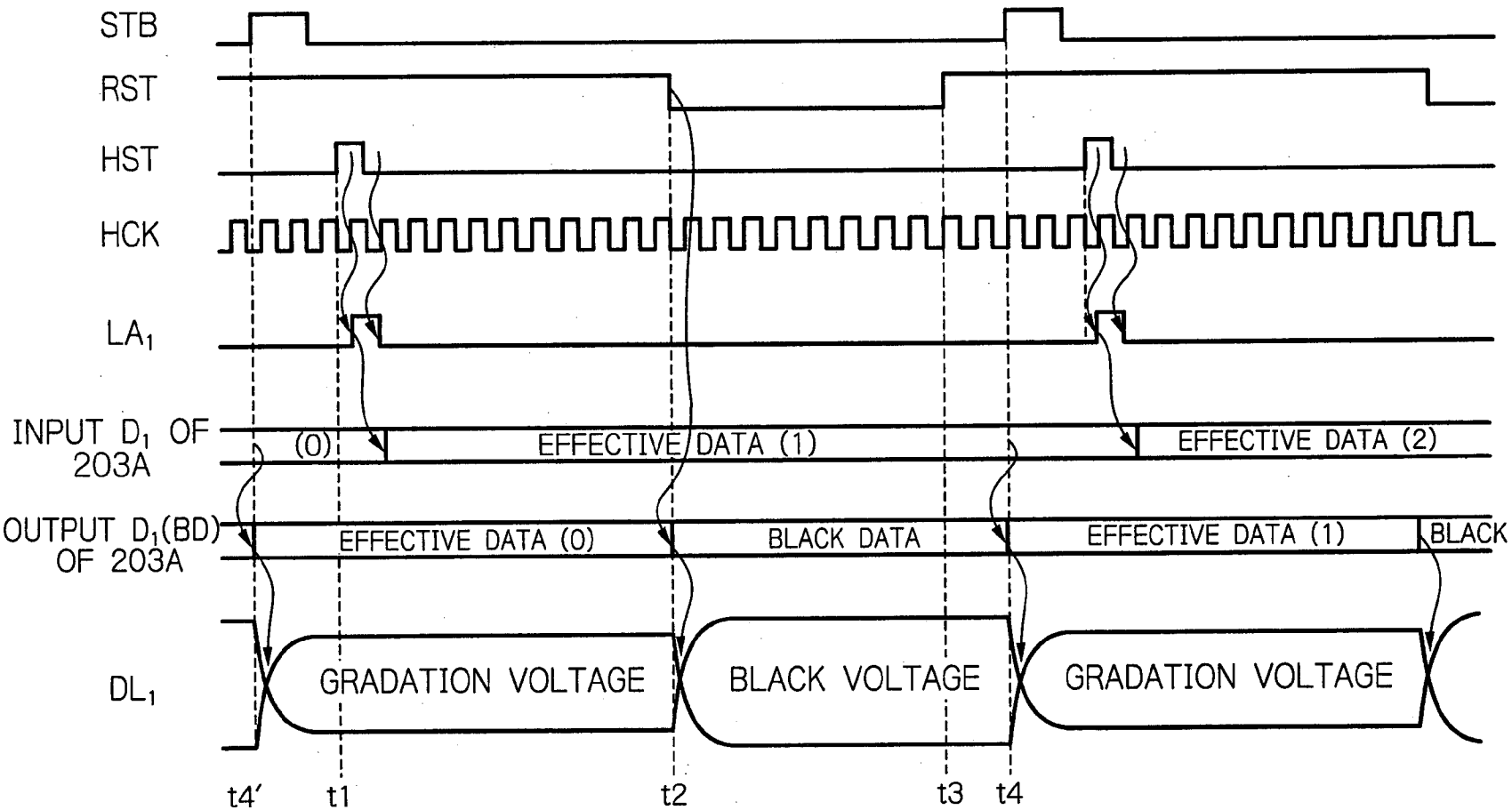
FIG. 9 is a timing diagram for explaining a first operation of the data line driver of FIG. 6.

Thus, in FIG. 9, a gradation voltage and a black voltage are alternately switched. In this case, the polarity of the gradation voltage is opposite to that of the black voltage during one strobe signal period, thus removing the residual image effect of a moving image.

Figure 10:
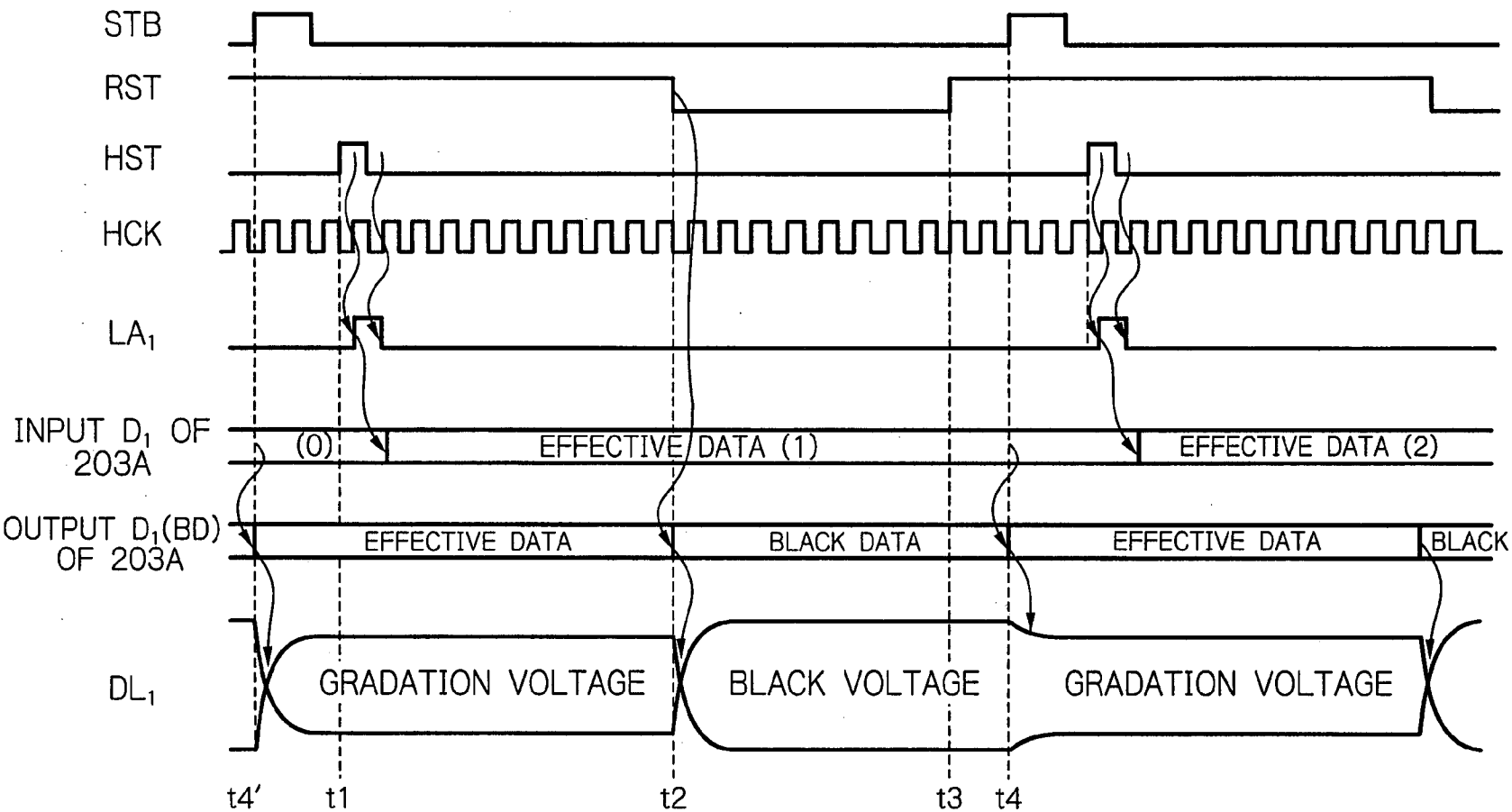
FIG. 10 is a timing diagram for explaining a second operation of the data line driver of FIG. 6.

A second operation of the data line driver of FIG. 6 is explained next with reference to FIG. 10 which also shows an operation for one data line such as $DL_1$. In FIG. 10, the polarity of the black voltage is the same as the gradation voltage of the next effective data. As a result, the black voltage can serve as a precharging voltage for the gradation voltage of the next effective data, which would improve the response of the gradation voltage.

Figure 11:
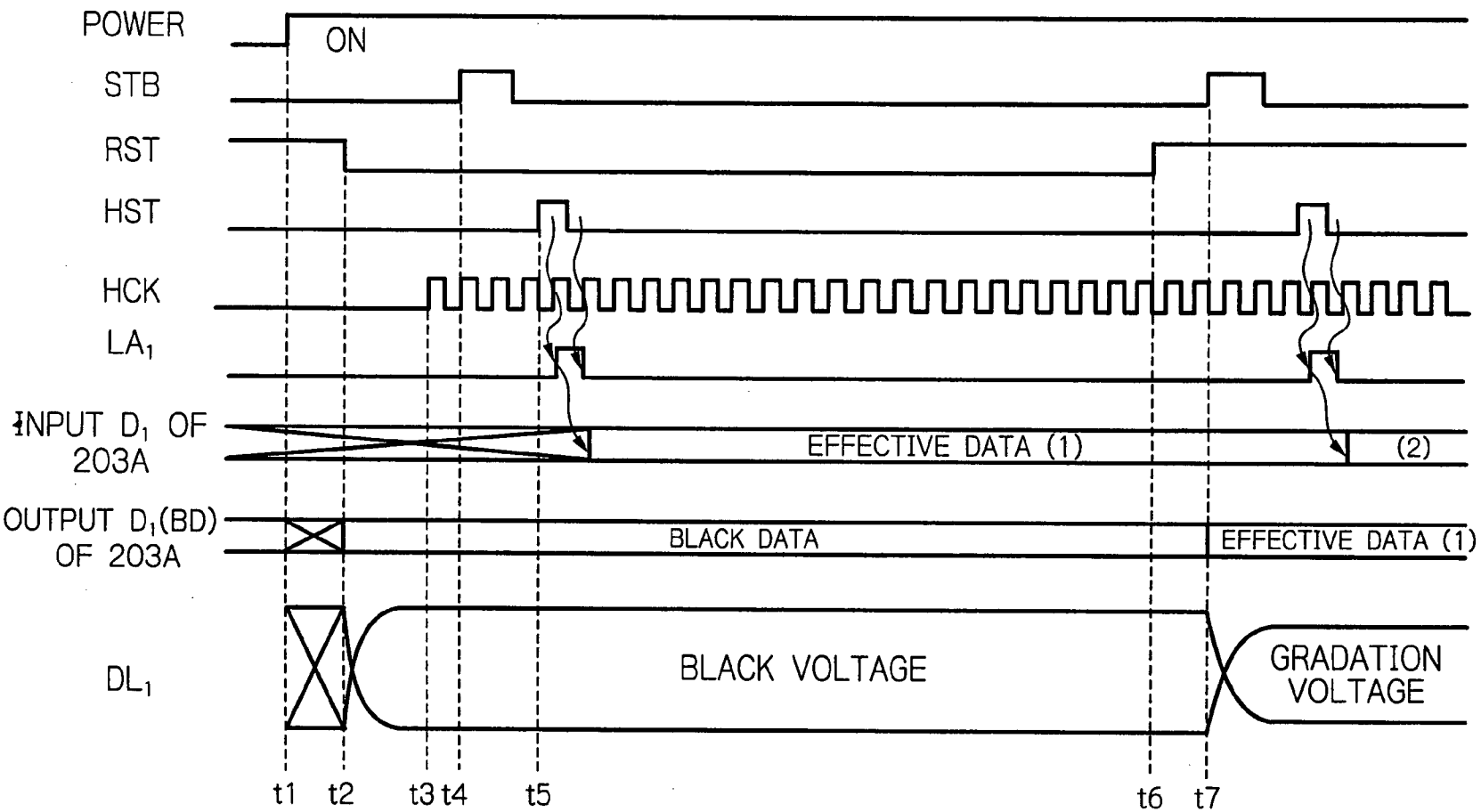
FIG. 11 is a timing diagram for explaining a third operation of the data line driver of FIG. 6.

A third operation of the data line driver of FIG. 6 is explained next with reference to FIG. 11 which shows an operation for one data line such-as $DL_1$. In FIG. 11, a horizontal clock signal HCK is asynchronously generated even after a power is turned ON.

First, at time t1, the power is turned ON.

Next, at time t2, when a reset signal RST is changed from high to low, reset-type D-type latch circuits LC1 of the data latch circuit 203A are reset, so that the data latch circuit 203A generates black data (=000000). As a result, the black data is supplied via the level shifter 204 and the D/A converter 205 to the output buffer 206. Thus, a black voltage corresponding to the black data is applied to the data line $DL_1$.

Next, at time t3, a horizontal clock signal HCK is generated; in this case, however, the reset signal RST is still reset, so that the data latch circuit 203A continues to generate the black data. Thus, the black voltage is still applied to the data line $DL_1$.

Next, at time t4, a strobe signal STB is generated; however, in this case, since the data latch circuit 203A is still reset, the data latch circuit 203A continues to generate the black data. Thus, the black voltage is still applied to the data line $DL_1$.

Next, at time t5, a horizontal start signal HST is generated, so that the horizontal shift register 201 generates a latch signal $LA_1$ in synchronization with the horizontal clock signal HCK. As a result, a video signal $D_1$ is latched as an effective data (1) in the data register 202 and is supplied to the data latch circuit 203A for the data line $DL_1$.

Even in this case, since the reset signal RST is still reset, the data latch circuit 203A continues to generate the black data. Thus, the black voltage is still applied to the data line $DL_1$.

Next, at time t6, the reset signal RST is changed from low to high, so that the black data remains in the data latch circuit 203A for the data line $DL_1$. Thus, the black voltage at the data line $DL_1$ is retained.

Finally, at time t7, when a strobe signal STB is generated while the reset signal RST remains high, the reset-type D-type latch circuit LC1 of the data latch circuit 203A passes the effective data (1) of the video signal $D_1$ via the level shifter 204 and the D/A converter 205 to the output buffer 206. As a result, a gradation voltage corresponding to the effective data (1) of the video signal $D_1$ is applied to the data line $DL_1$.

Thus, in FIG. 11, a reset signal RST is reset before the generation of a horizontal clock signal HCK, to apply the black voltage to the data line $DL_1$.

Figure 12:
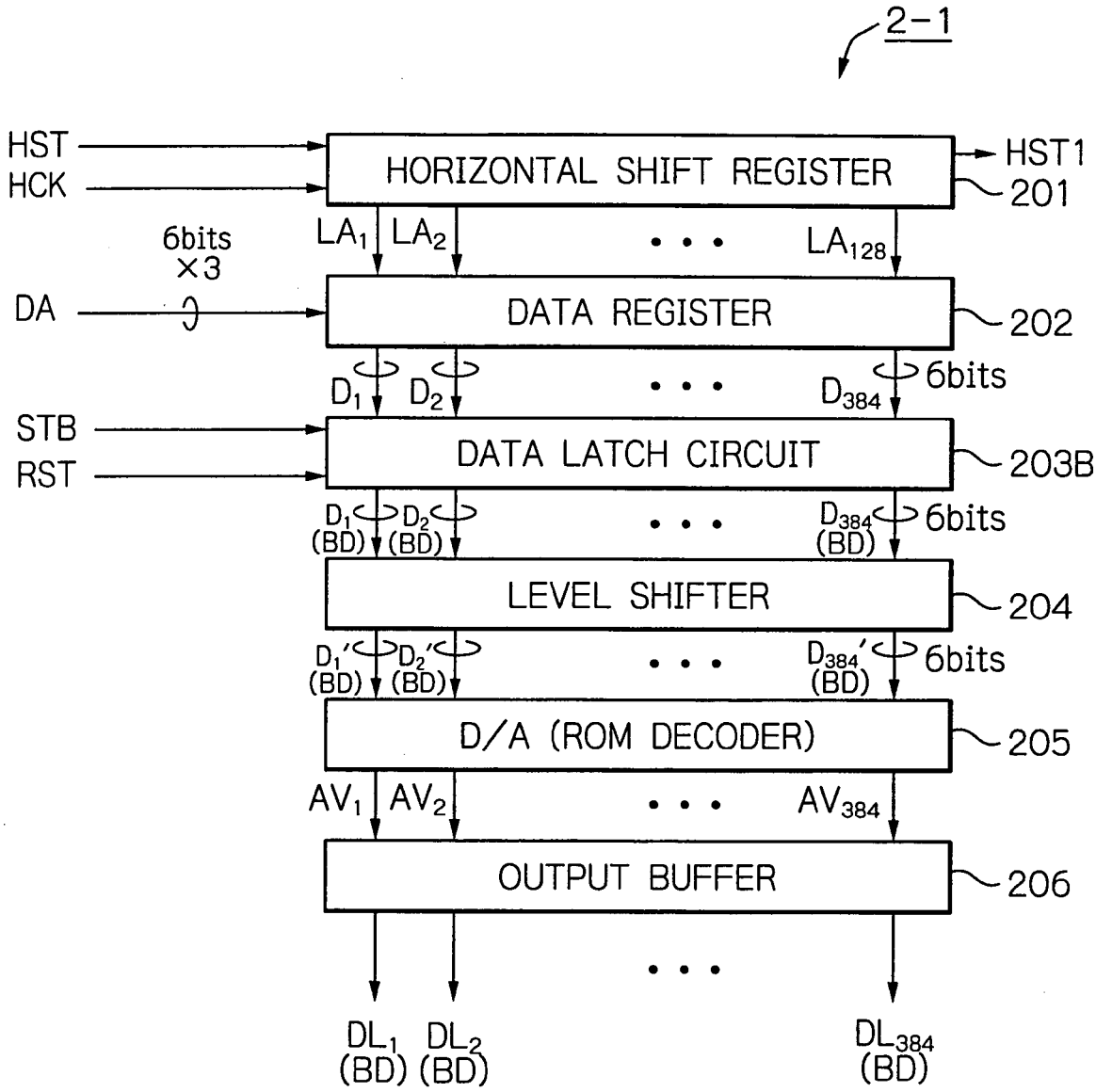
FIG. 12 is a block circuit diagram illustrating a second embodiment of the data line driver according to the present invention.

In FIG. 12, which illustrates a second embodiment of the data line driver according to the present invention, the data latch circuit 203A of FIG. 6 is replaced by a data latch circuit 203B. In FIG. 12, note that black data is defined by fixed gradation data (111111).

Figure 13A:
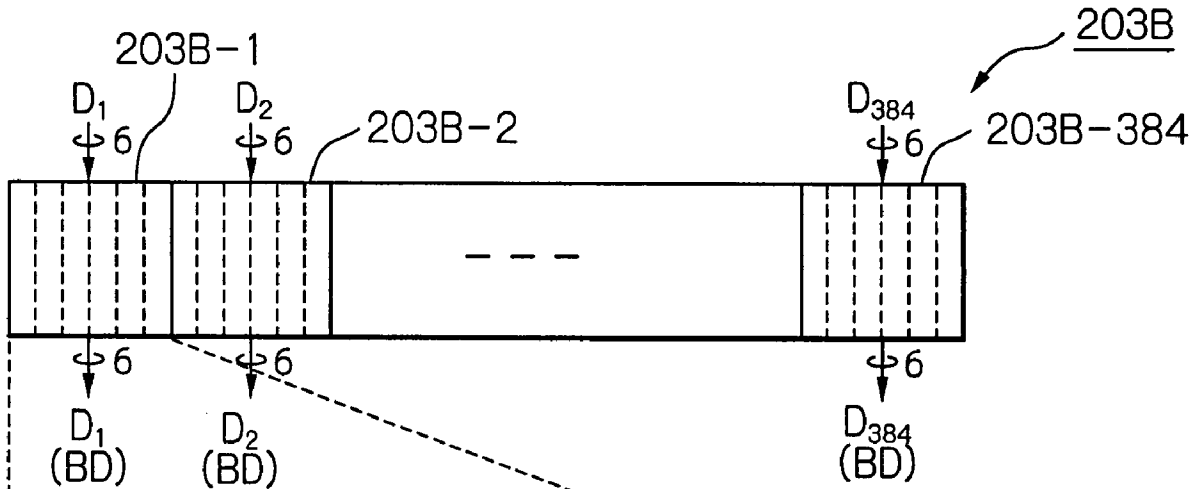
FIG. 13A is a detailed block circuit diagram of the data latch circuit of FIG. 12.
Figure 13B:
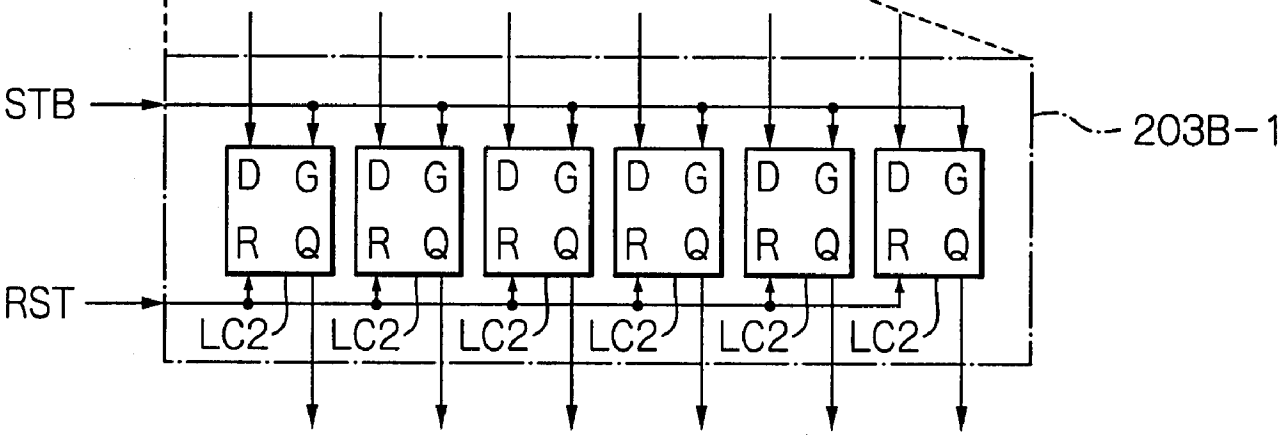
FIG. 13B is a detailed block circuit diagram of the 6-bit latch circuit of FIG. 13A.

The data latch circuit 203B is constructed by 384 6-bit latch circuits 203B-1, 203B-2, . . . , 203B–384 as illustrated in FIG. 13A, and each of the 6-bit latch circuits 203B-1, 203B-2, . . . , 203B–384 is constructed by six reset-type D-type latch circuits LC2 as illustrated in FIG. 13B. That is, the 6-bit latch circuits 203B-1, 203B-2, . . . , 203B–384 latch the video data signals $D_1$, $D_2$, . . . , $D_{384}$, respectively, of the data register 202 in synchronization with a rising edge of the strobe signal STB. On the other hand, the 6-bit latch circuits 203B-1, 203B-2, . . . , 203B–384 are reset by the reset signal RST so that each of the 6-bit latch circuits 203B-1, 203B-2, . . . , 203B–384 generates black data (=111111).

Figures 14A, 14B:
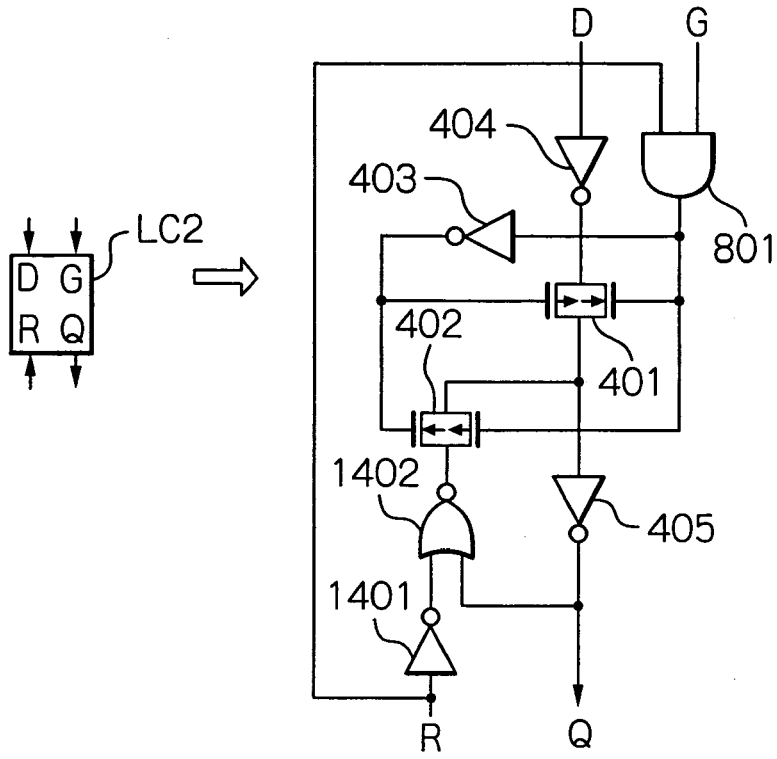
Fig. 14A PRIOR ART
Fig. 14B PRIOR ART
FIG. 14A is a logic circuit diagram of the reset-type D-type latch circuit of FIG. 13B.
FIG. 14B is a truth table of the reset-type D-type latch circuit of FIG. 13A.

As illustrated in FIG. 14A, in the reset-type D-type latch circuit LC2, includes an inverter 1401 and a NOR circuit 1402 instead of the NAND circuit 802 of FIG. 8A. Therefore, the reset-type D-type latch circuit LC2 operates in accordance with the truth table of FIG. 14B.

When the reset signal RST is high (="1"), the reset-type D-type latch circuit LC2 operates in the same way as the D-type latch circuit LC of FIG. 4A. That is, when the voltage at the gate terminal G is high (="1"), the transfer gates 401 and 402 are turned ON and OFF, respectively. As a result, the voltage at the data terminal D passes through the inverter 404, the transfer gate 401 and the inverter 405 to reach the output terminal Q. On the other hand, when the voltage at the gate terminal G is low (="0"), the transfer gates 401 and 402 are turned OFF and ON, respectively. As a result, the voltage at the data terminal Q is positively fed back from the output terminal Q via the NOR circuit 1402 and the transfer gate 402 and the inverter 405 to the output terminal Q, so that the voltage at the output terminal Q is held.

When the reset signal RST is low (="0"), the reset-type D-type latch circuit LC2 is reset. That is, the output signal of the AND circuit 801 is low (="0") regardless of the voltage at the gate terminal G, so that the transfer gates 401 and 402 are turned OFF and ON, respectively. Also, the output signal of the NOR circuit 1402 is low (="0") regardless of the voltage at the output terminal Q. As a result, the output signal of the NOR circuit 1402 (="0") passes through the transfer gate 402 and the inverter 405, the voltage at the output terminal Q is reset at high (="1").

Thus, when the reset signal RST is low (="0"), the data latch circuit 203B is reset, so that the black data BD is applied to the data lines $DL_1$, $DL_2$, . . . , $DL_{384}$.

In FIGS. 6 and 12, fixed gradation data (000000) or (111111) can represent white data. Even in this case, the quality of a moving image or the removing effect of a residual image of a moving image can be improved.

Figure 15:
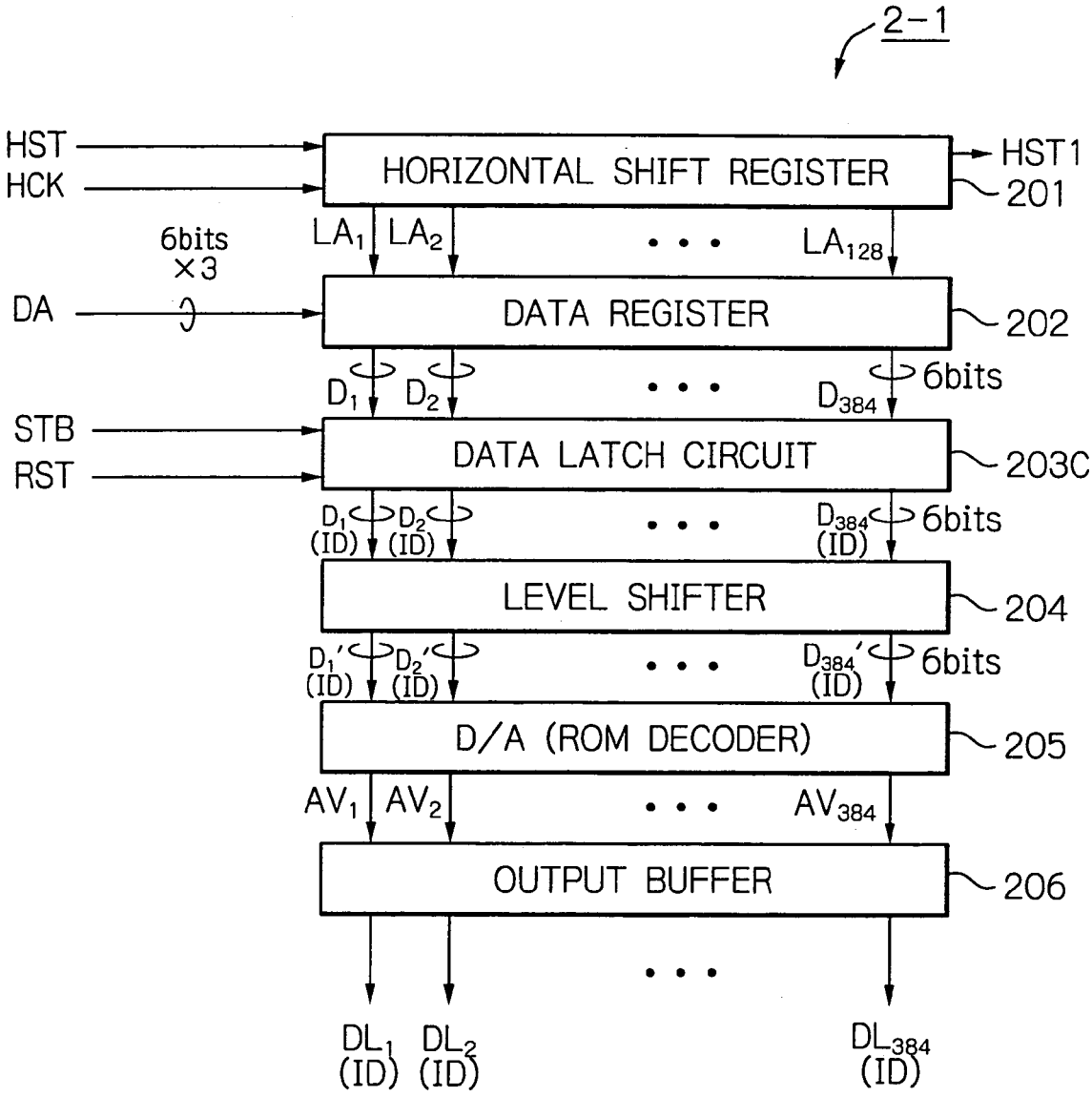
FIG. 15 is a block circuit diagram illustrating a third embodiment of the data line driver according to the present invention.

In FIG. 15, which illustrates a third embodiment of the data line driver according to the present invention, the data latch circuit 203A or 203B of FIG. 6 or 12 is replaced by a data latch circuit 203C. In FIG. 15, when the data latch circuit 203C is reset, the data latch circuit 203 generates fixed intermediate data ID such as (100000) instead of black data (000000) or (111111). Even in this case, the quality of a moving image or the removing effect of a residual image of a moving image can be improved.

Figure 16A:
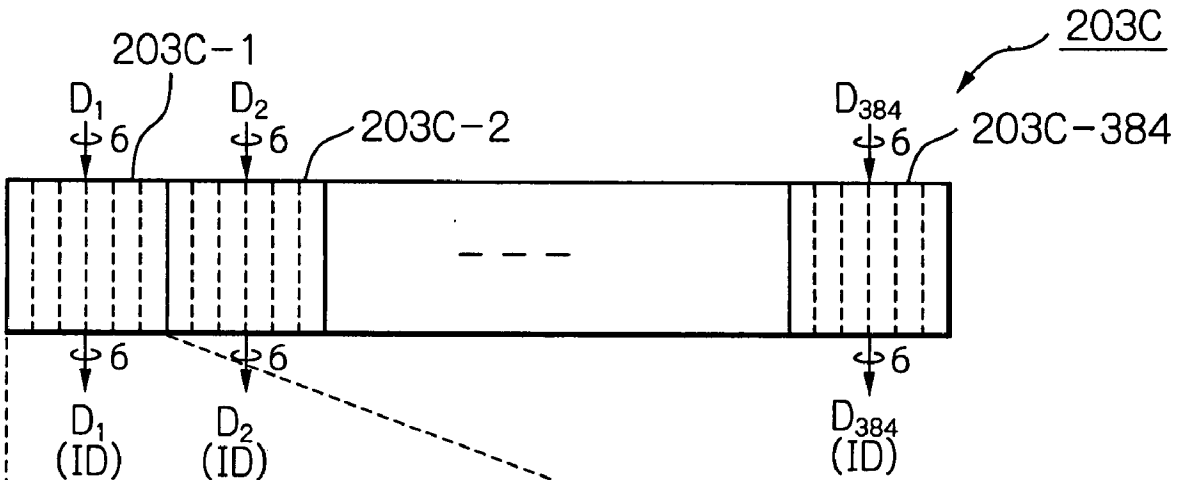
FIG. 16A is a detailed block circuit diagram of the data latch circuit of FIG. 15.
Figure 16B:
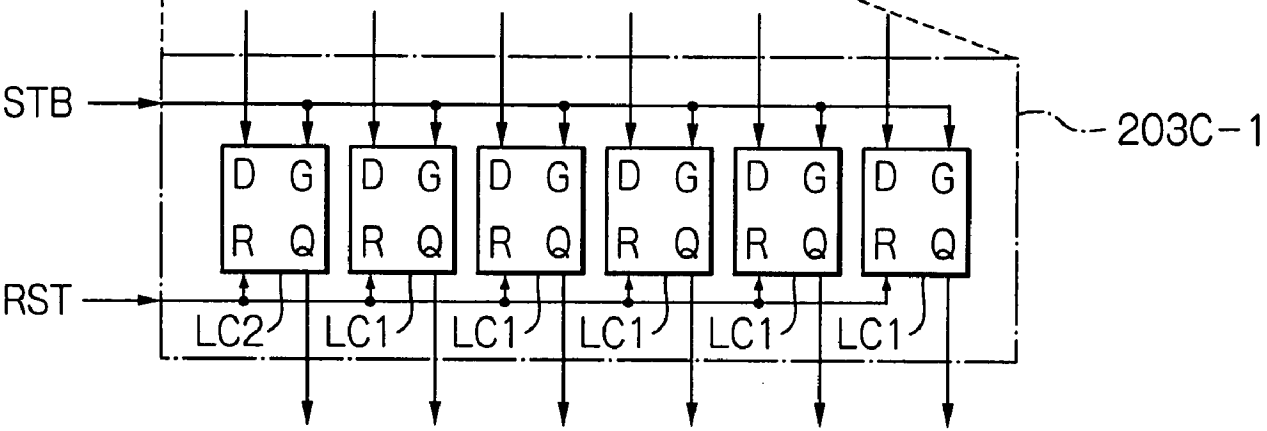
FIG. 16B is a detailed block circuit diagram of the 6-bit latch circuit of FIG. 16A.

The data latch circuit 203C is constructed by 384 6-bit latch circuits 203C-1, 203C-2, . . . , 203C–384 as illustrated in FIG. 16A, and each of the 6-bit latch circuits 203C-1, 203C-2, . . . , 203C–384 is constructed by six reset-type D-type latch circuits LC1 or LC2 as illustrated in FIG. 16B. That is, the 6-bit latch circuits 203C-1, 203C-2, . . . , 203C–384 latch the video data signals $D_1$, $D_2$, . . . , $D_{384}$, respectively, of the data register 202 in synchronization with a rising edge of the strobe signal STB. On the other hand, the 6-bit latch circuits 203C-1, 203C-2, . . . , 203C–384 are reset by the reset signal RST so that each of the 6-bit latch circuits 203C-1, 203C-2, . . . , 203C–384 generates fixed intermediate data.

Thus, when the reset signal RST is low (="0"), the data latch circuit 203C is reset, so that the fixed intermediate data is applied to the data lines $DL_1$, $DL_2$, . . . , $DL_{384}$.

Note that the present invention can be applied to other plane type display apparatus such as a plasma display apparatus, or an organic or inorganic electroluminescence (EL) display apparatus.

As explained hereinabove, according to the present invention, since a data latch circuit including reset-type D-type latch circuits is provided instead of a switch circuit including an enormous number of switches, the data line driver can be made small in size.

The invention claimed is:

1. A data line driver for driving data lines of a display apparatus, comprising:

a data register adapted to sequentially latch video data signals in synchronization with latch signals;

a data latch circuit adapted to latch all said sequential video data signals latched in said data register in synchronization with a strobe signal to generate digital output signals;

a digital/analog converter adapted to convert the digital output signals of said data latch circuit into analog signals; and an output buffer adapted to apply the analog signals of said digital/analog converter to said data lines, said data latch circuit having a reset terminal adapted to receive a reset signal, so that the digital output signals of said data latch circuit are reset by said reset signal to fixed gradation data regardless of said strobe signal.

2. The apparatus as set forth in claim 1, wherein said fixed gradation data represents black data.

3. The apparatus as set forth in claim 1, wherein said fixed gradation data represents white data.

4. The apparatus as set forth in claim 1, wherein said fixed gradation data represents an intermediate data between black data and white data.

5. The apparatus as set forth in claim 1, wherein said data latch circuit comprises a plurality of latch circuits for one of said data lines, said latch circuits fetching said video data signals in synchronization with said strobe signal when said reset signal is at a first level, said latch circuits being reset when said reset signal is at a second level.

6. The apparatus as set forth in claim 5, wherein each of said latch circuits is reset to generate a low level signal.

7. The apparatus as set forth in claim 5, wherein each of said latch circuits is reset to generate a high level signal.

8. The apparatus as set forth in claim 5, wherein at least one of said latch circuits is reset to generate a low level signal, and at least one of said latch circuits is reset to generate a high level signal.

9. The apparatus as set forth in claim 5, wherein each of said latch circuits comprises a reset-type D-type latch circuit with a data terminal adapted to receive one bit of one of said sequential video data signals, a gate terminal adapted to receive said strobe signal, a reset terminal adapted to receive said reset signal, and an output terminal adapted to generate a corresponding bit of one of the digital output signals of said data latch circuit.

10. The apparatus as set forth in claim 9, wherein data at the output terminal of each of said latch circuits is the same as data at the data terminal thereof when data at the gate terminal and the reset terminal thereof are at a first level, and wherein data at the output terminal of each of said latch circuits is "0" or "1" when data at the reset terminal thereof is at a second level.

* * * * *